United States Patent [19]

Wuellenweber

[11] Patent Number: 4,623,143

[45] Date of Patent: Nov. 18, 1986

[54] WRIST AND ANKLE WEIGHTS

[76] Inventor: Mary F. Wuellenweber, P.O. Box 828, Concord, N.H. 03301

[21] Appl. No.: 691,697

[22] Filed: Jan. 15, 1985

[51] Int. Cl.[4] ..... A63B 23/04

[52] U.S. Cl. ..... 272/119; 272/143

[58] Field of Search ..... 272/119, 143, 96, 94, 272/93; 128/402

[56] References Cited

U.S. PATENT DOCUMENTS

| | | | |
|---|---|---|---|
| D. 195,134 | 4/1963 | Tarbox | D34/5 |
| 3,278,184 | 10/1966 | Rosenbaum | 272/119 |
| 3,374,636 | 3/1968 | Mason | 272/119 |
| 4,322,072 | 3/1982 | White | 272/119 |
| 4,326,533 | 4/1982 | Henderson | 128/402 |
| 4,384,714 | 5/1983 | Kimura | 272/119 |
| 4,394,012 | 7/1983 | Egbert et al. | 272/119 |
| 4,396,190 | 8/1983 | Wilkerson | 272/119 |

*Primary Examiner*—Richard J. Apley
*Assistant Examiner*—John L. Welsh

[57] ABSTRACT

An athletic and rehabilitative aid to build muscle mass and increase muscle tones in the peripheral extremities—the legs and arms.

The malleable belt is comprised of a foam rubber like material containing synchronized weighted bars to form a flexible cartridge, which is covered with a fabric like material.

The cartridge is used within a removeable exterior cover, allowing the user to vary the amounts of weight. The weights are inserted thru a zippered like opening in the cover. The exterior cover has two parallel straps with fasteners, which allow it to be easily attached to an arm or leg.

The uniqueness of this aid allows one to use varied amounts of weighted cartridges easily exchanged.

10 Claims, 5 Drawing Figures

WRIST AND ANKLE WEIGHTS

FIELD OF SEARCH

224/225, 272/57, 272/67, 272/80, 272/82, 272/96, 272/117, 272/118, 272/119, 272/131, 272/143, 272/144, 128/80, D1/21, D21/238, D2/380

U.S. PATENT DOCUMENTS

Patents Reference Cited In Search

| | | | |
|---|---|---|---|
| 1,729,209 | 11/1926 | A. Curtis | 128/80 |
| 4,408,600 | 10/1983 | E. Davis | 128/80 |
| 4,239,210 | 12/1980 | L. Lambert | 272/134X |
| 3,278,184 | 12/1963 | H. Rosenbaum | 272/96 |
| 3,525,141 | 5/1968 | G. Smith | 272/57D |
| 2,241,833 | 3/1940 | L. Waller | 272/57 |
| 1,074,939 | 10/1913 | C. Fredrikson | 272/57 |
| 4,396,190 | 8/1983 | C. Wilkerson | 272/119 |
| 4,322,072 | 3/1982 | G. White | 272/5 |
| 3,334,898 | 8/1967 | D. McCrory | 272/96 |
| 3,406,968 | 11/1964 | G. Mason | 272/96X |
| 4,239,212 | 12/1980 | D. Hickey | 272/141 |
| 4,239,211 | 12/1980 | C. Wilkerson | 272/119 |
| 3,924,851 | 12/1975 | H. Winston | D2/380 |
| 4,385,761 | 3/1981 | M. Rice | D2/381 |
| Des. 261,196 | 11/1981 | R. Griffin | 224/229 |
| Des. 197,820 | 3/1964 | E. Baker | D21/238 |

BRIEF SUMMARY

Although there have been many types of exercise, athletic, and rehabilitative aids they seem to have flaws. In an attempt to solve the four main problems and refine the flaws, this invention appeared to have the right components.

The four main flaws or problems cited were shifting of weight or weight mass, body discomfort, irregular conformity to arms or legs, and consumer expense.

The following are problems incurred by different types of weighted devices, the problems are peculiar to their design and should be examined as such.

In researching, examining, and using the pocketed-bullet type devices the records indicated the follow problems. The bullets did not always insert as easily and quickly as claimed. Retrieving the bullets was hard. The bullets were not padded, nor were they sufficiently padded within the containers. The round elongated shapes did not conform comfortably to the arm or leg. The last problem cited was misplacement of the bullets by the user.

The second type of device researched examined and used were the pre-molded type aids. The user was limited to a predetermined weight factor. These units could not add or subtract extra weights to their design. The user would have to purchase another limited set of predetermined weights.

In researching, examining, and using the lead shot type of devices many similar problems were discovered. The lead shot type devices did not conform to the arms or legs as snugly. Often they were cited as bulky, bunchy, irritating and shifty becoming off-balance. Too often they were dependent on lateral fasteners, which came open during rapid exercise movements. The nature of the materials used in their design rendered them inflexible. Some of these lead shot devices had to be replaced by the users, because they were accidentally piercd and lost their contents.

It has thus become the object of my invention to solve as many of those problems cited from the previous research, examination, and use.

It is the object of my invention to design a universal exterior cover that will allow the insertion of a single cartridge weight.

It is the object of my invention to produce an aide which will easily contour and conform to the users leg or arm.

It is an object of my invention to provide the user with contact comfort of such an aid.

It is the object of my invention to provide weighted ingots securely embedded that will not shift, move, crowd, or fall out of pockets.

It is the object of my invetion to provide quick, easy insertion of a cartridge and quick easy retrieving of a cartridge.

It is the object of my invention to provide a durable, washable universal exterior cartridge cover.

It is the object of this invention to provide user with a simple and inexpensive aid, which will be timeless in design.

The following description of the drawing and appended drawings will make clear how the foregoing objects are achieved.

BRIEF DESCRIPTION

FIGS. 1–5 illustrate the embodiment of an athletic and rehabilitative aid in accordance to the said invention.

FIG. 1 demonstrates a cut away perspective view of the aid in an open condition and illustrates the components thereof.

FIG. 2 demonstrates an elevated end view of the ingot illustrating the ingot design.

FIG. 3 demonstrates a perspective view of the cartridge protector cover.

FIG. 4 demonstrates a cross sectional view of the cartridge exposing the pliability and contour of the foam and weighted ingots.

FIG. 5 demonstrates a perspective view of the exterior cartridge cover and illustrating the components thereof.

DETAILED DESCRIPTION

Figure 1:
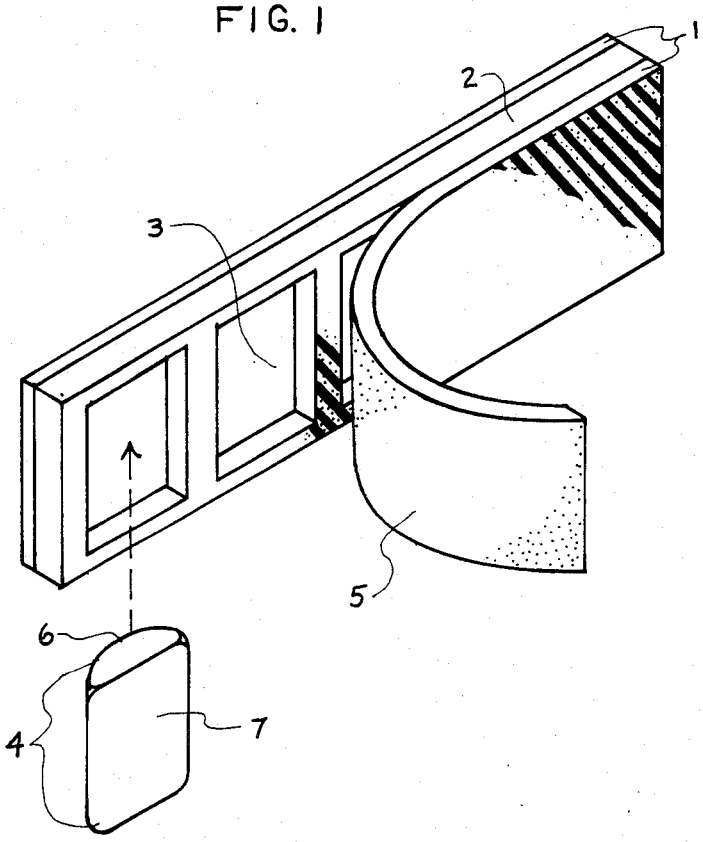

In reference now to FIG. 1 which shows the process of assembly for a weighted cartridge as part of the invention. A thick, rectangular foam rubber like strip 2 is comprised of a plurality of rectangular openings 3, spacially balanced within the strip 2. The rectangular openings 3 accommodate premolded ferrous and non-ferrous metal ingots 4 such as lead; (see FIG. 2) the thick rectangular strip 2 is posteriorly bonded 5 to a thinner foam rubber like rectangular strip 1 having the exact rectangular periphery as the thick rectangular strip 2. The ferrous or non-ferrous ingots 4 are craddled and bonded into the thick rectangular strip 2. A second thinner foam rubber like rectangular strip 1 having the exact rectangular periphery, as the thick rectangular strip 2 is bonded anteriorly to the rectangular strip 2. This process forms a closed, pliable cartridge FIG. 1, containing securely embedded metal ingots 4 that will not shift, move, crowd, or fall out.

Figure 2:
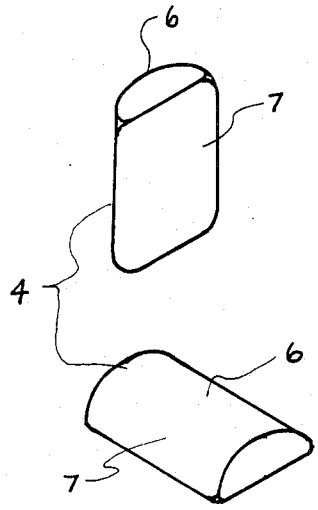

In reference now to FIG. 2 which displays the design for the ingot 4 which has a flat bottom 7 and an arched top 6. A ferrous or non-ferrous type material such as lead is molded into an ingot 4 having a flat bottom 7, conforming to the appendage surface and an arched top 6 to facilitate wrapping the aid around the arm or leg. The ingot aids in the flexibility and pliability of the cartridge, ref. FIG. 1/FIG. 4.

Figure 4:
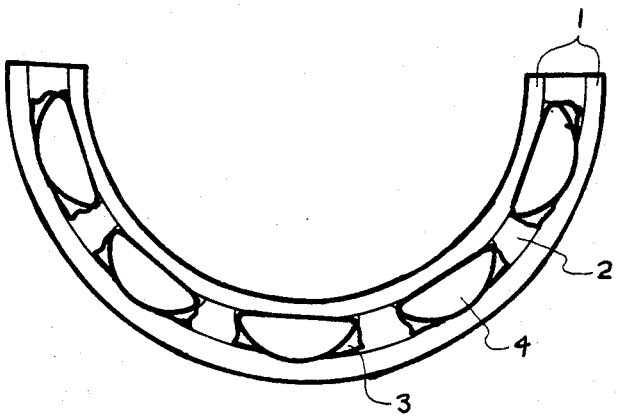

In reference now to FIG. 4 which exposes a circular configuration of the cartridge FIG. 1 demonstrating pliability and contour of the foam rubber like material in relation to the ferrous and non-ferrous type ingots 4.

Figure 3:
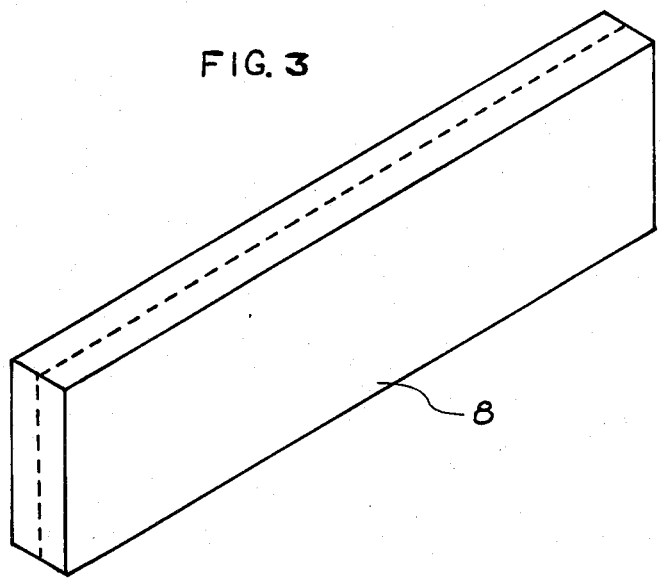

In reference to FIG. 3 demonstrates the cartridge protector cover 8. A rectangular piece of fabric like material is cut approximately twice the size of the cartridge FIG. 1. The fabric like material is folded over and stitched across the horizontal side and on one lateral side. The cartridge FIG. 1 is inserted into a fabric like protective covering 8 and stitched closed on the remaining lateral side to produce a snug fitting protective cover 8.

Figure 5:
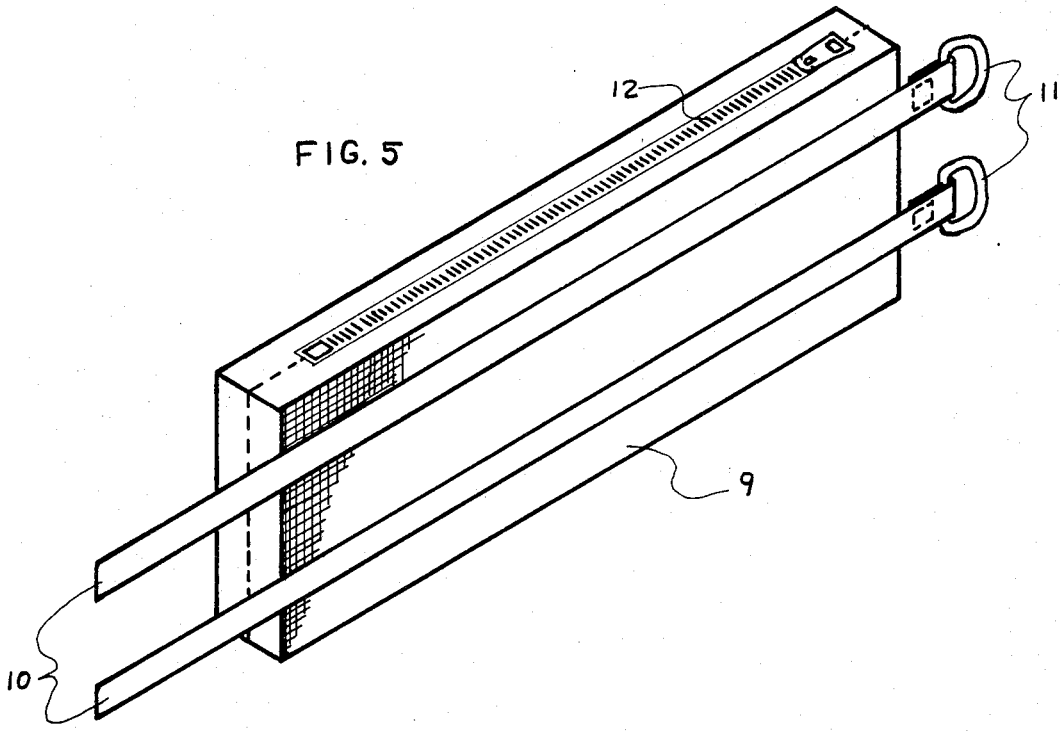

In reference to FIG. 5 an exterior and ornamental cartridge cover 9 which illustrates the components thereof. A rectangular piece of fabric like material such as nylon, canvas, cotton, or polyester blend is cut into two pieces, approximately the size of the covered cartridge FIG. 1/FIG. 3. The two pieces of fabric like material are stitched together at the lateral sides and horizontally across the bottom side and partially stitched on the top horizontal side leaving an opening to insert a zipper type closure 12, such as a nylon, metal, plastic, velcro, or interlocking snap like closures. The exterior cover 9 has two webbed fabric like straps 10 placed equally apart from an imaginary horizontal midline on the rectangle.

The straps 10 run parallel and horizontally across the exterior cartridge cover 9 and exceed sufficiently past the lateral ends. On one end of the said straps 10 proximal to the lateral ends of the exterior cartridge covers 9, a fastener type mechanism 11 such as a D-ring, nylon-interlocking buckle, clasp, or velcro is attached enabling the opposing end of the straps 10 to be secured, when in use.

Having described and disclosed my invention let it be understood that alternative forms may be employed by the inventor within the spirit and scope of the invention claimed.

I claim:

1. A wrist and ankle weight device which comprises:
a substantially flexible rectangular middle layer having at least one opening receiving at least one weighted member;
substantially flexible rectangular front and back layers;
a cover for enveloping said layers; and
a removable outer cover for enveloping said layers and said cover,
said outer cover including a closure device and securing means for securing said device to the limb of a wearer.

2. The device of claim 1, wherein said middle layer is secured to said front layer.

3. The device of claim 1, wherein said middle layer is secured to said back layer.

4. The device of claim 1, wherein said weighted member has a semi-annular or circular configuration.

5. The device of claim 1, wherein said closure device is a zipper.

6. The device of claim 1, wherein said closure device is a snap fastener.

7. The device of claim 1, wherein said closure device is a hook and loop fastener.

8. The device of claim 1, wherein said securing means is a ring fastening device.

9. The device of claim 1, wherein said securing means is a buckle device.

10. The device of claim 1, wherein said securing means is a hook and loop fastening device.

* * * * *